US012740645B1

(12) United States Patent
Goshorn

(10) Patent No.: US 12,740,645 B1
(45) Date of Patent: Sep. 22, 2026

(54) PORTABLE HEADREST

(71) Applicant: James M Goshorn, Port Royal, PA (US)

(72) Inventor: James M Goshorn, Port Royal, PA (US)

( * ) Notice: Subject to any disclaimer, the term of this patent is extended or adjusted under 35 U.S.C. 154(b) by 0 days.

(21) Appl. No.: 18/644,235

(22) Filed: Apr. 24, 2024

(51) Int. Cl.
*A47C 7/38* (2006.01)

(52) U.S. Cl.
CPC ..... *A47C 7/383* (2013.01)

(58) Field of Classification Search
CPC ..... A47C 7/383
See application file for complete search history.

(56) References Cited

U.S. PATENT DOCUMENTS 3,043,626 A * 7/1962 Requa ..... A47C 7/383 297/216.12
3,351,371 A * 11/1967 Headrick ..... B66C 1/127 294/77
5,643,184 A * 7/1997 Toso ..... A61F 5/026 450/155
5,918,332 A * 7/1999 Dees ..... A47G 9/1045 5/639

FOREIGN PATENT DOCUMENTS

WO WO-2014161027 A1 * 10/2014 ..... B60N 2/882

* cited by examiner

*Primary Examiner* — Nicholas McFall
(74) *Attorney, Agent, or Firm* — John J. Elnitski, Jr.

(57) ABSTRACT

A portable headrest to be used with different seating accommodations. The headrest has a pillow adapted for a user to rest against. There is at least one restraining strap. The restraining strap has a pillow end and an attachment end, where the pillow end of the restraining strap is attached to the pillow. There is a connection device attached at each attachment end of the restraining straps. The connection device is adapted to attach the attachment end to a support forward of where the user is seated.

9 Claims, 18 Drawing Sheets

PORTABLE HEADREST

BACKGROUND

The field of invention generally relates to a headrest for a seated user. More specifically, the present invention relates to a headrest that is portable to be used with different seating accommodations.

Portable headrests attach to a chair with a back. One type attaches to a chair back in a permanent fashion. The other type is a pad added on to a high back chair, where the headrest is tied to the high back of the chair near the top of the high back. There is nothing on the market to easily add a headrest to a seat that has a low back or no back at all. There is nothing on the market to easily transfer a headrest from one seat to another seat. What is needed is a headrest that can be used universally with a seat having no back, low back or high back. Also, what is needed is a headrest that can be easily fitted to the individual user.

It is an object of the present invention to provide an adjustable headrest that can be used with seats that have a low back or no back, yet provide a user with head support.

SUMMARY OF THE INVENTION

A portable headrest to be used with different seating accommodations. The headrest has a pillow adapted for a user to rest against. There is at least one restraining strap. The restraining strap has a pillow end and an attachment end, where the pillow end of the restraining strap is attached to the pillow. There is a connection device attached at each attachment end of the restraining straps. The connection device is adapted to attach the attachment end to a support forward of where the user is seated.

DETAILED DESCRIPTION

Figure 1:
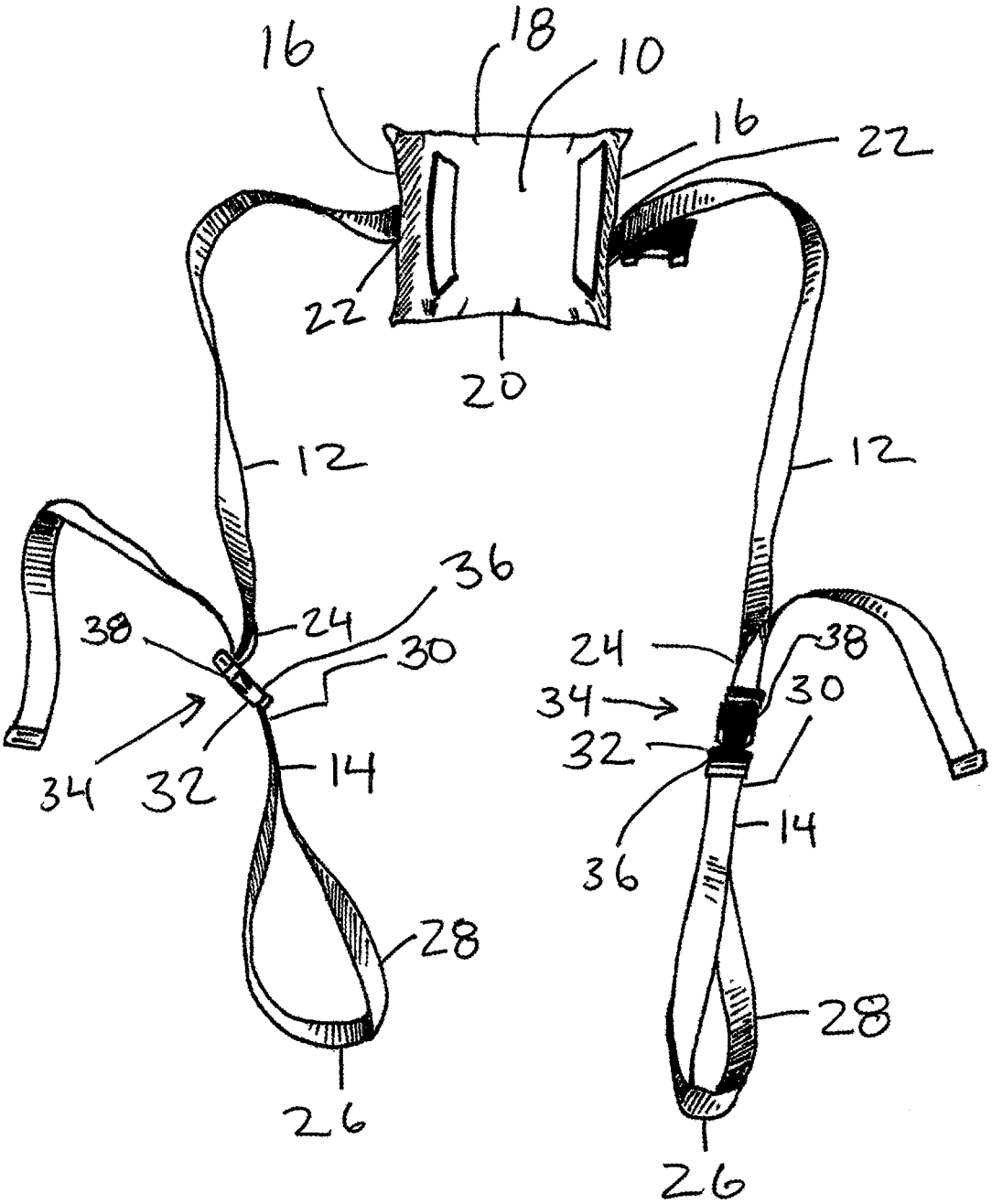
FIG. 1 is a perspective front view of a portable headrest according to the present invention.
Figure 2:
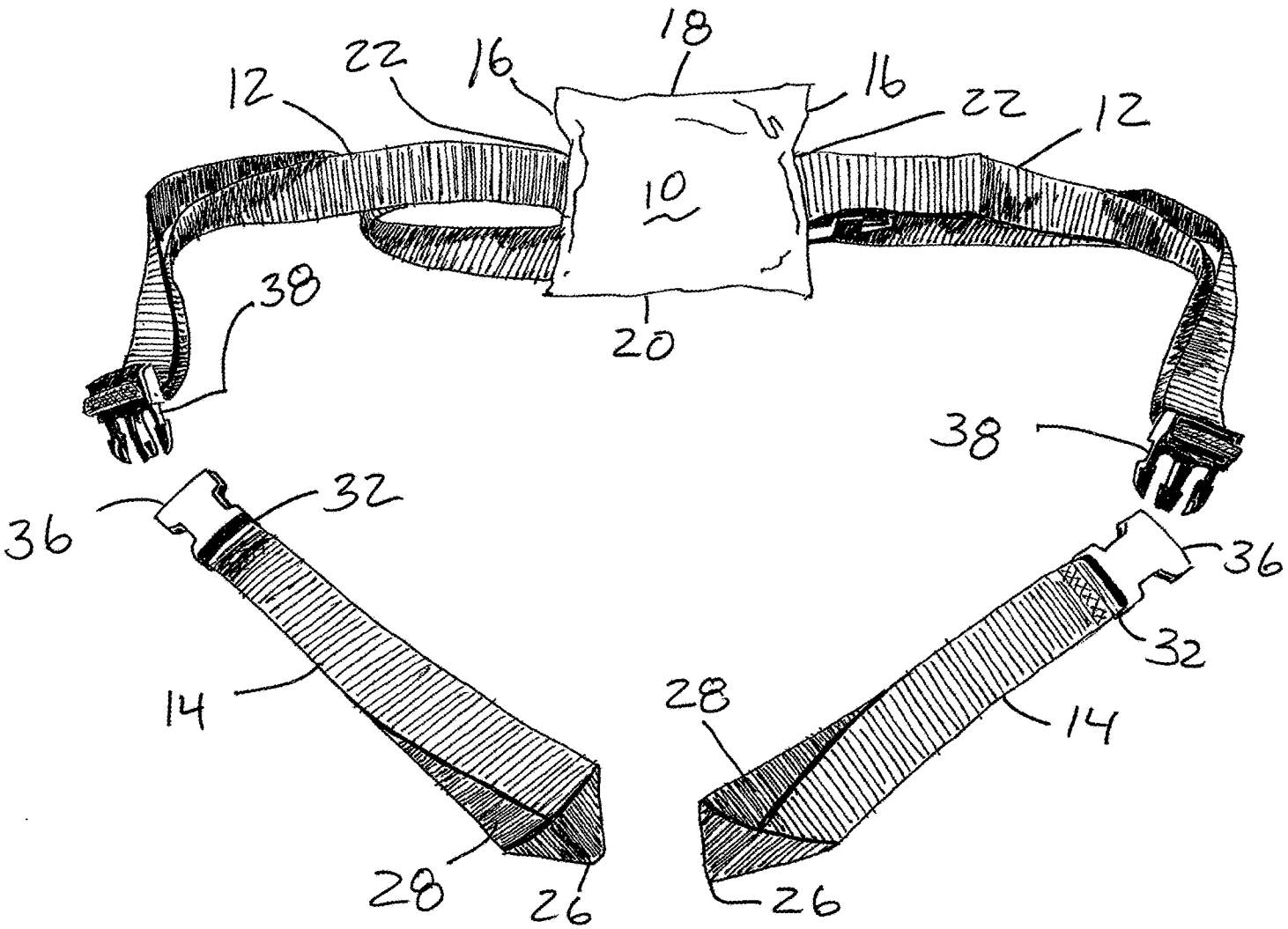
FIG. 2 is a perspective front view of a portable headrest according to the present invention.
Figure 3:
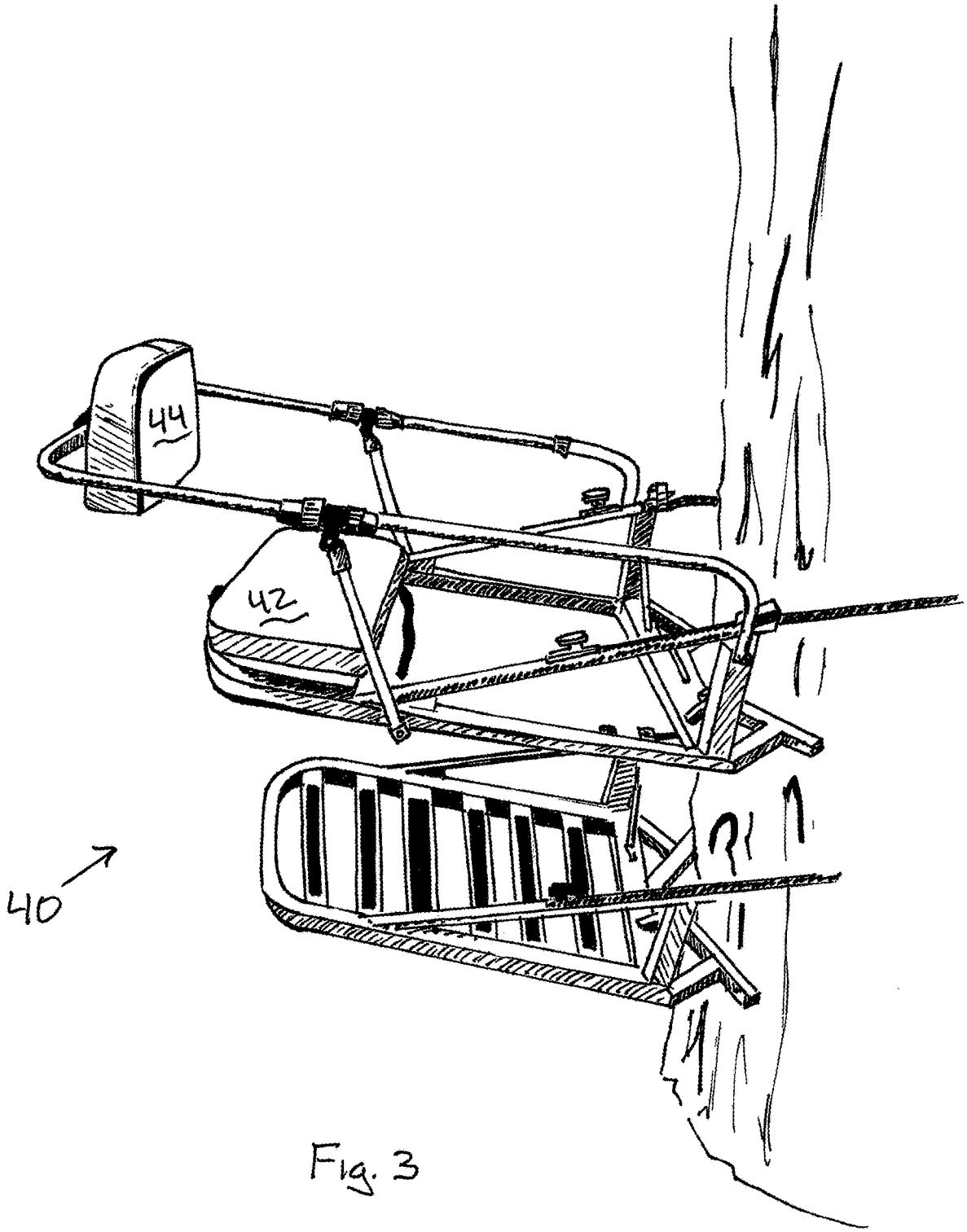
FIG. 3 is a perspective side view of a tree stand according to the present invention.
Figure 4:
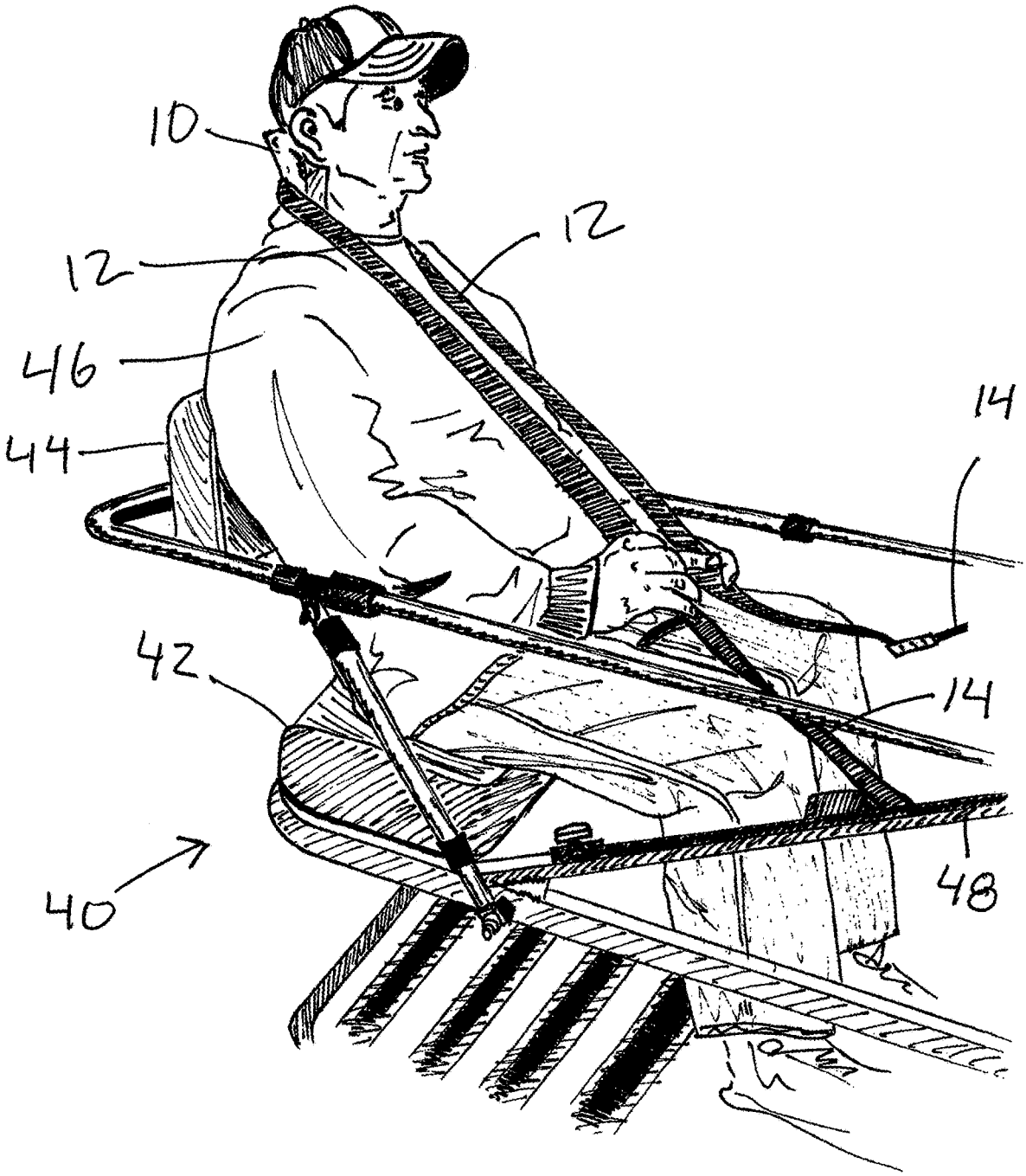
FIG. 4 is a perspective side view of a tree stand and portable headrest according to the present invention.

The present invention is a portable headrest for use with different seating accommodations. A first version of the portable headrest is shown in FIGS. 1-2. FIG. 1 shows the portable head rest having a pillow 10, two restraining straps 12, and two removable attachment straps 14. The pillow 10 is shown having a profile of 2 sides 16, a top 18 and a bottom 20. The restraining straps 12 have a pillow end 22 and an attachment end 24. The pillow ends 22 of the restraining straps 12 are attached to the sides 16 of the pillow 10. The attachment straps 14 attach to the attachment end 24 of the restraining straps 12. FIG. 2 shows the two removable attachment straps 14 detached from the restraining straps 12. The attachment straps 14 have an attachment end 26 with a loop end 28 and a restraining strap end 30 with a buckle end 32. There is strap interface device 34 show as a side release buckle combination. The buckle ends 32 have a socket end 36 of the side release buckle combination. The attachment ends 24 of the restraining straps have a plug end 38 of the side release buckle combination. FIG. 3 shows a tree stand 40 with a seat 42 and a low back rest 44. FIG. 4 shows a user 46 seated in the tree stand 40 of FIG. 3 and using the portable headrest. FIG. 4 shows the pillow 10 positioned behind the neck of the user 46 and the restraining straps 12 attached to supports 48 of the tree stand 40. In FIG. 4, when the user 46 leans back on the pillow 10, the restraining straps 12 prevent the neck of the user 46 from moving any further backwards. The combination of the pillow 10 and the restraining straps 12 provides a headrest for the user 46 without the need of directly connecting to the seat back 44. All that is needed is the connection of the restraining straps 12 to something forward of the user 46. While the headrest is shown connected to supports 48 of the tree stand 40, it could also include connection to the tree instead of the tree stand 40.

Figure 5:
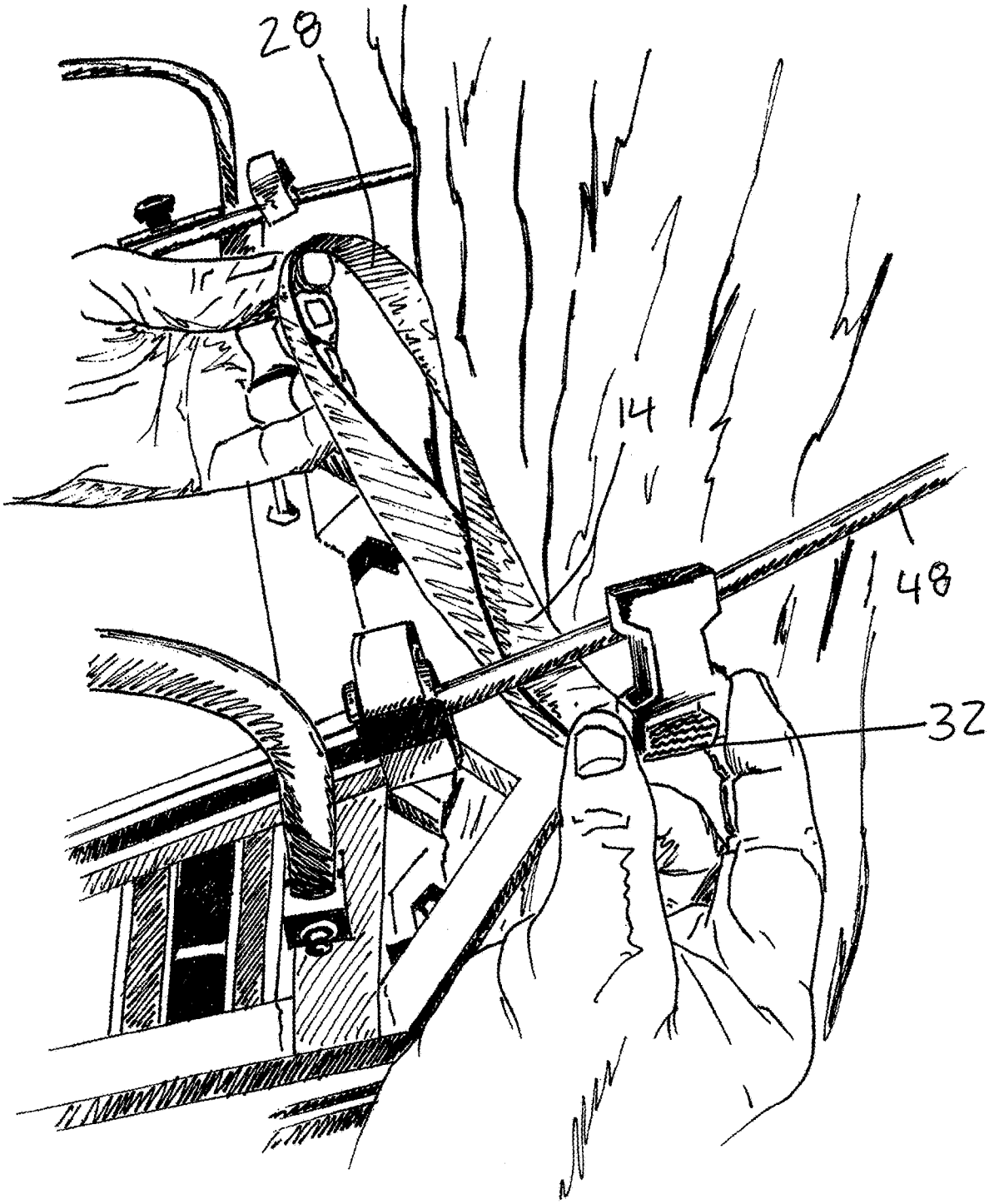
FIG. 5 is a perspective view of an attachment strap according to the present invention.
Figure 6:
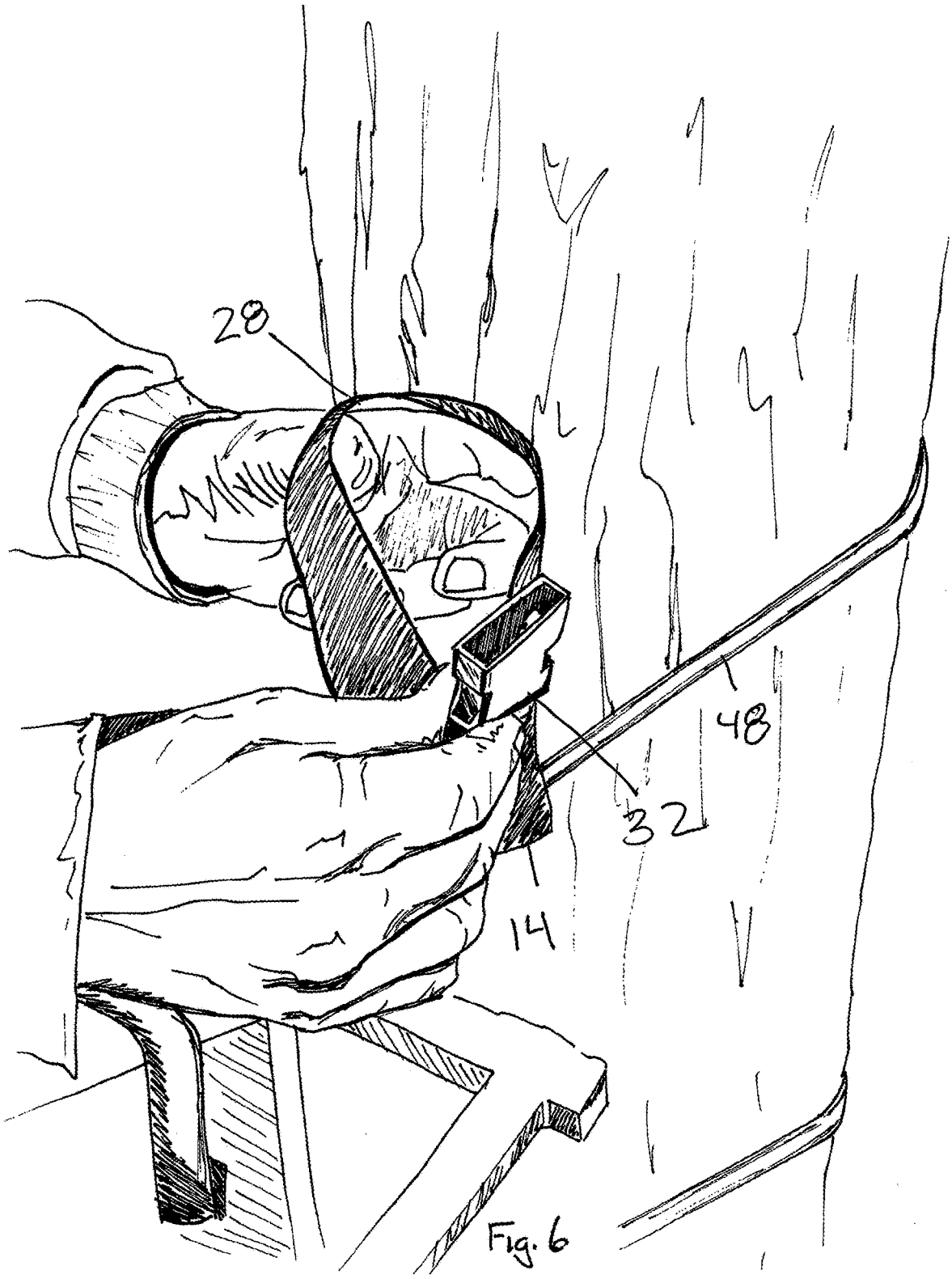
FIG. 6 is a perspective view of an attachment strap according to the present invention.
Figure 7:
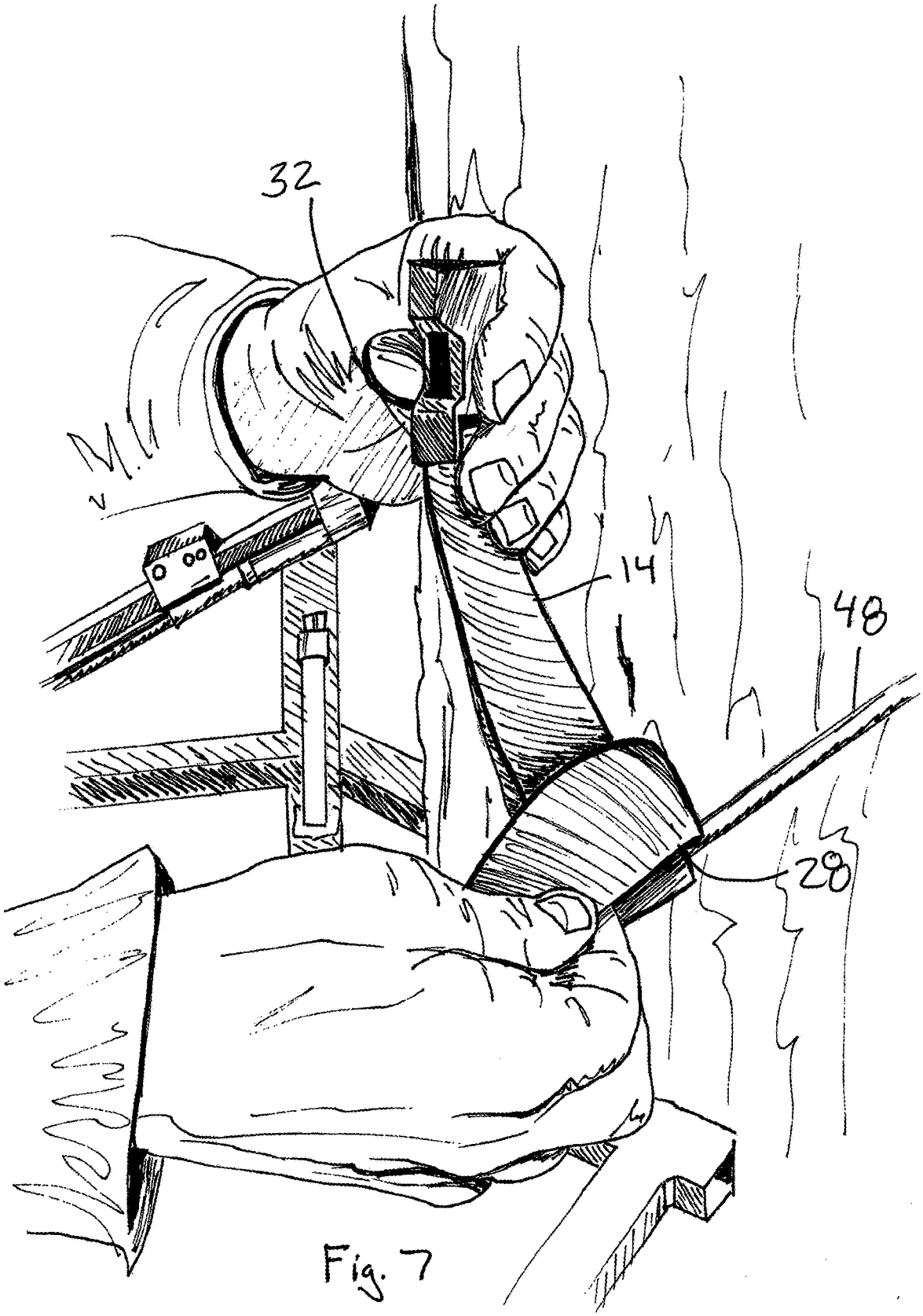
FIG. 7 is a perspective view of an attachment strap according to the present invention.
Figure 8:
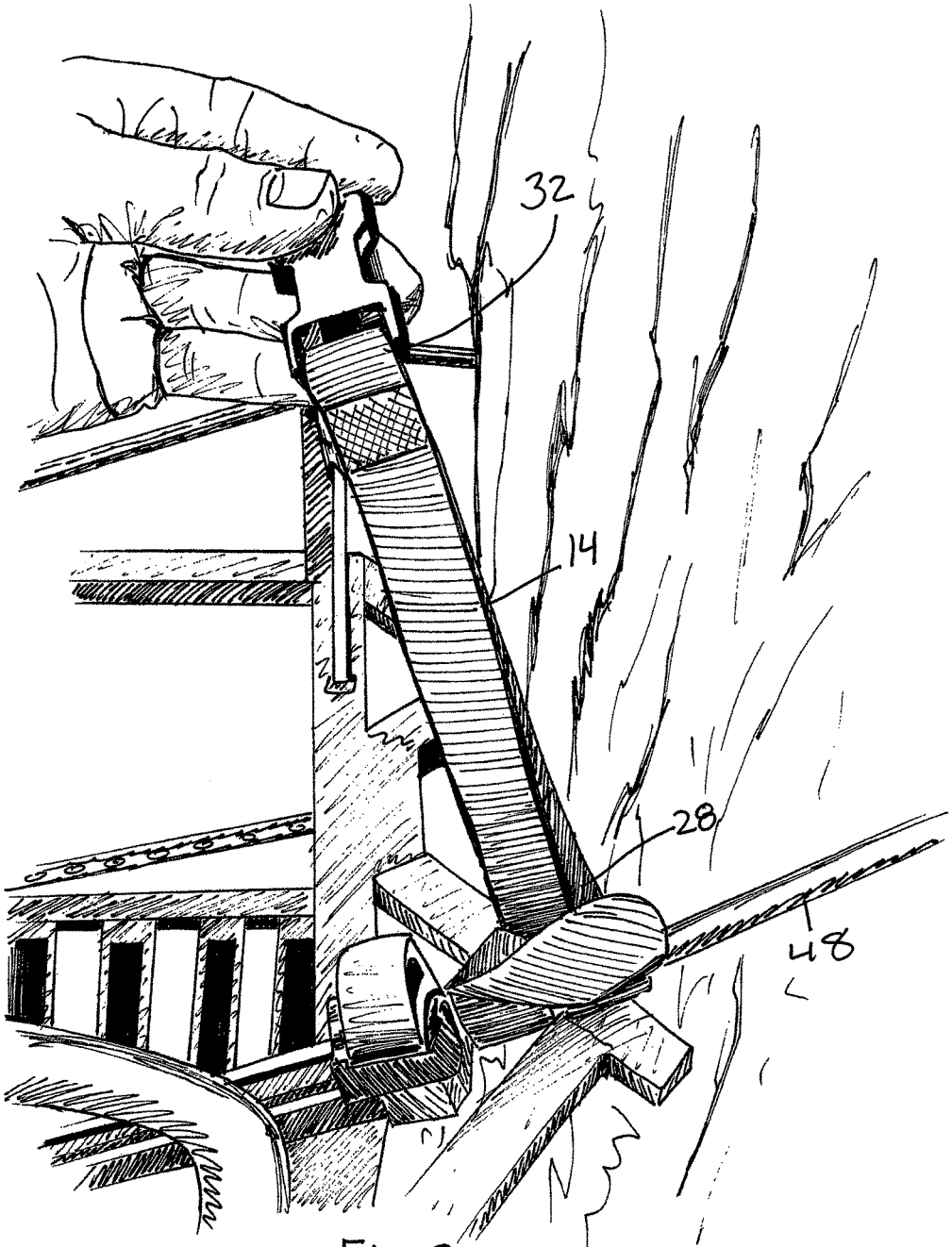
FIG. 8 is a perspective view of an attachment strap according to the present invention.
Figure 9:
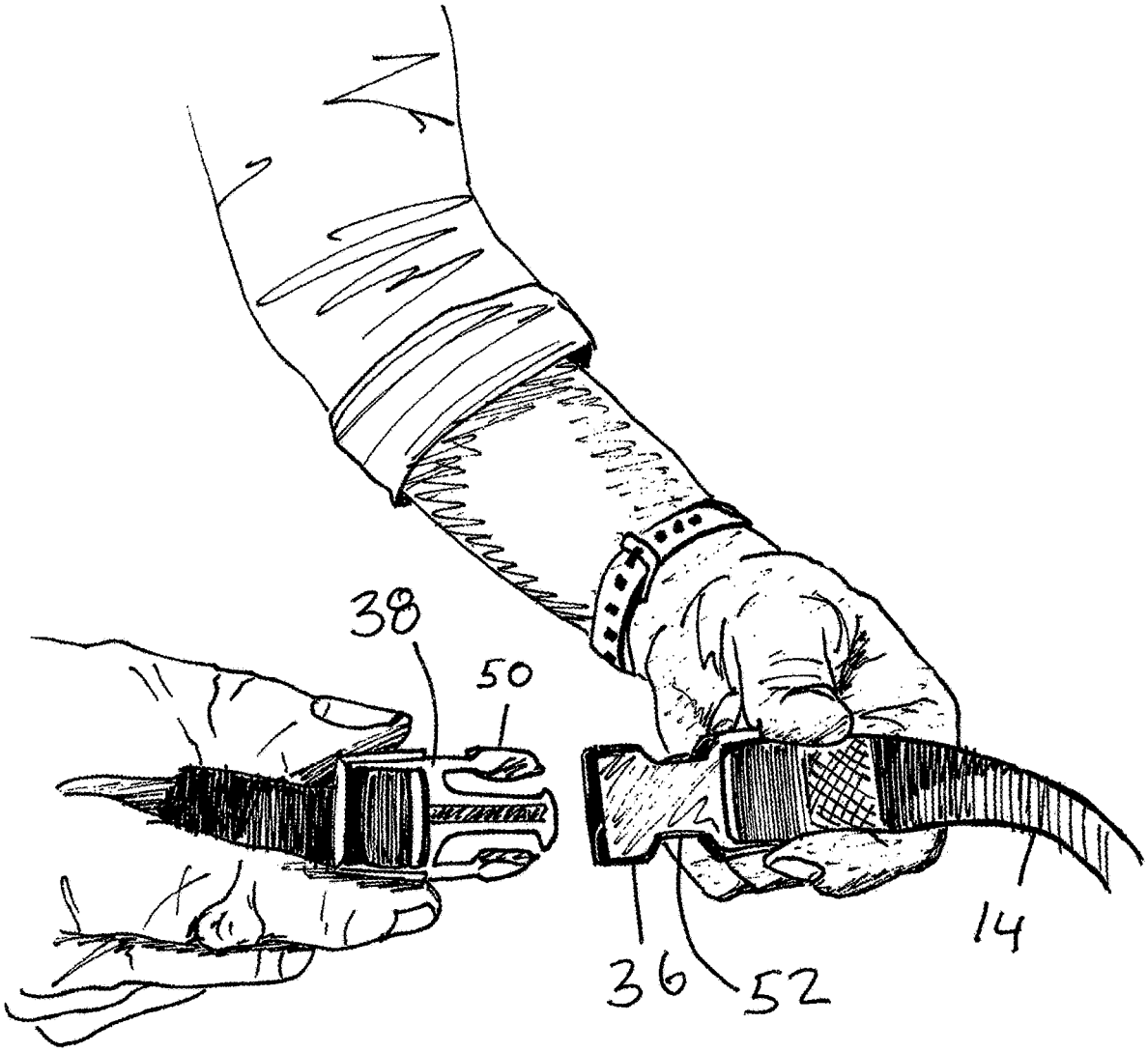
FIG. 9 is a perspective view of a connection of a restraining strap to an attachment strap according to the present invention.
Figure 10:
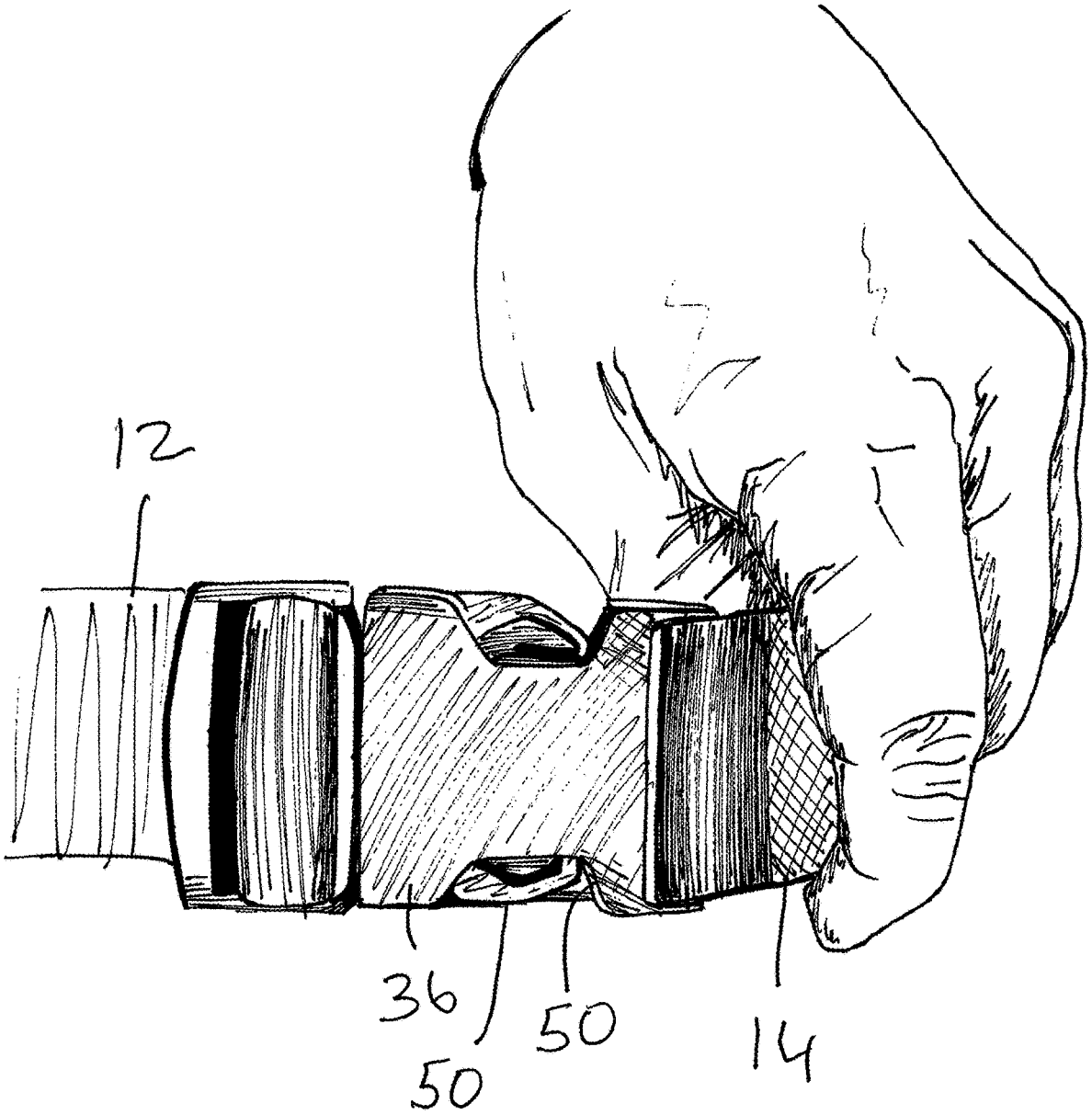
FIG. 10 is a perspective view of a connection of a restraining strap to an attachment strap according to the present invention.
Figure 11:
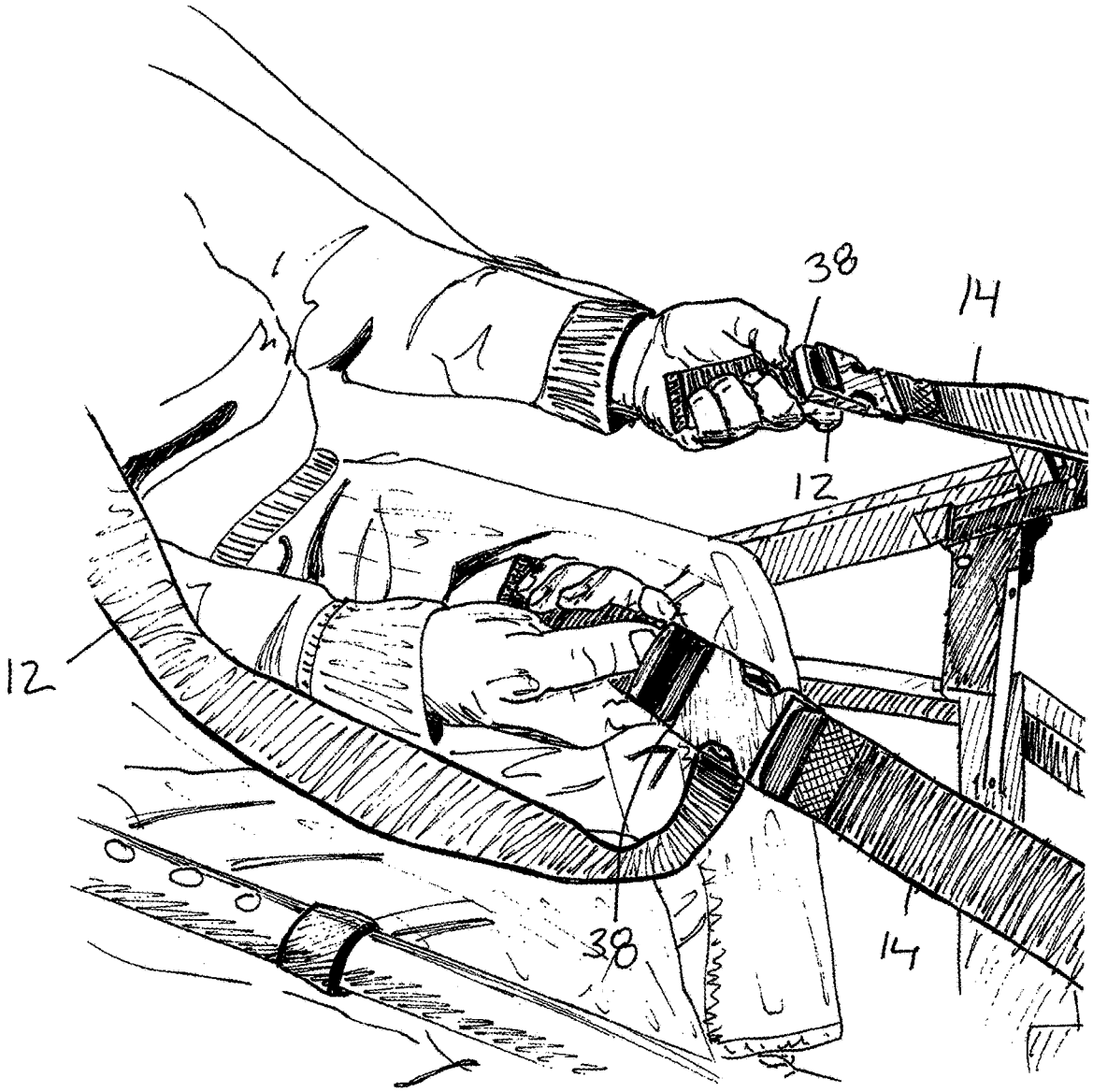
FIG. 11 is a perspective view of adjustment of a restraining strap according to the present invention.
Figure 12:
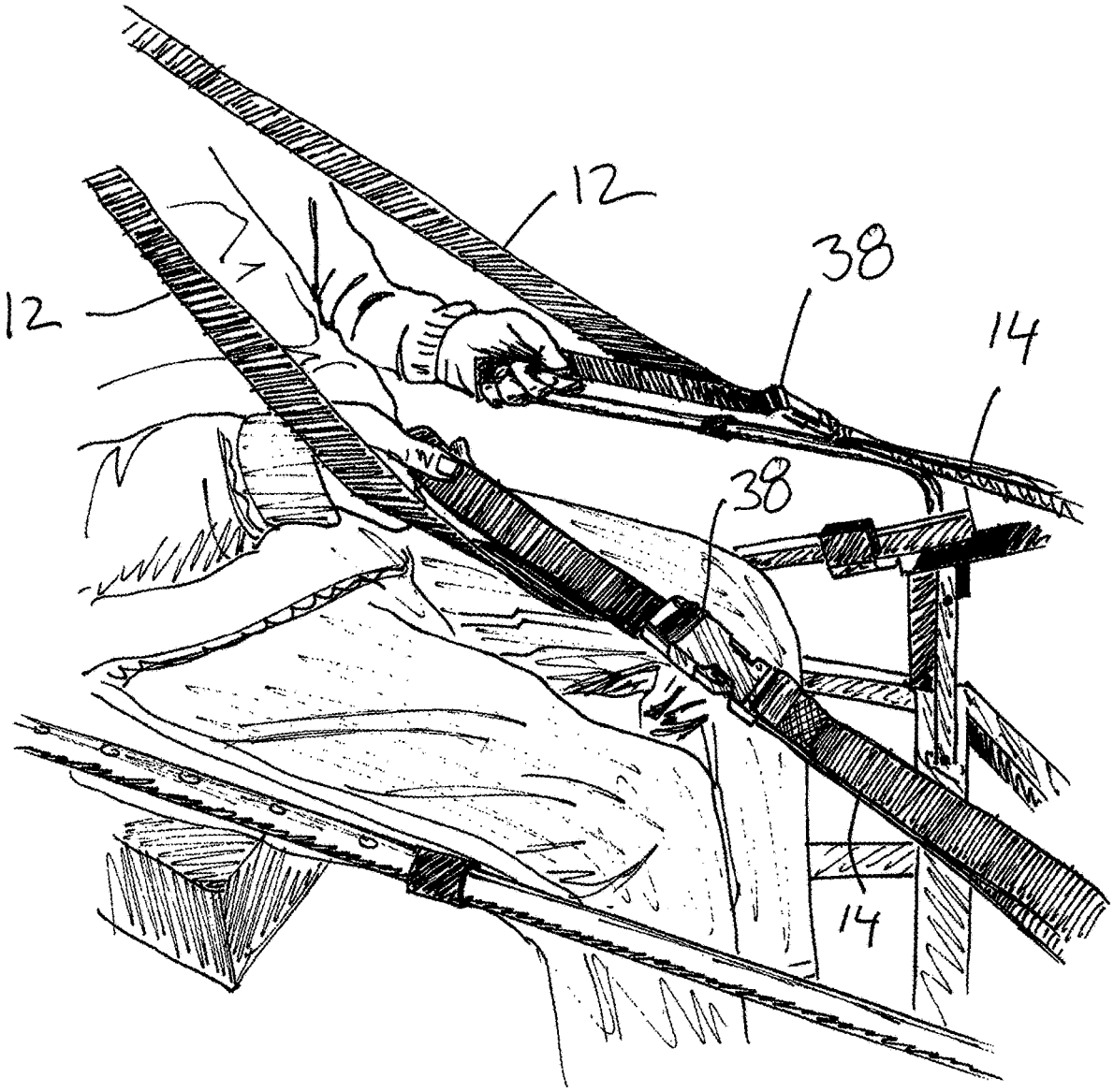
FIG. 12 is a perspective view of adjustment of a restraining strap according to the present invention.

FIGS. 5-8 show attachment of one of the attachment straps 14 to one of the supports 48 of the tree stand 40. FIG. 5 shows the attachment strap 14 below the support 48 and prepared to be looped over the support 48. FIG. 6 shows the buckle end 32 of the attachment strap 14 about to be threaded through the loop end 28 of the attachment strap 14 to encircle the support 48 of the tree stand 40. FIG. 7 shows the buckle end 32 of the attachment strap 14 threaded through the loop end 28 of the attachment strap 14. FIG. 8 shows the attachment strap 14 tightened around the support 48 of the tree stand 40. Once the attachment straps 14 are secured to the supports 48 of the tree stand 40, the attachment straps 14 are connected to the restraining straps 12 by connecting the plug end 38 of the restraining straps to the buckle end 32 of the attachment straps 14, as show in FIGS. 9-10. FIG. 9 shows the plug end 38 of the restraining strap just before the plug end 38 is inserted into the socket end 36 of the attachment strap 14. The plug end 38 is shown including lock tabs 50 and the socket end 36 including tab openings 52. The lock tabs 50 flex inward as the plug end 38 is inserted into the socket end 36. The lock tabs 50 flex back and into the tab openings 52 of the socket end 36 when the plug end 38 is fully inserted as show in FIG. 10. The connection of the attachment straps 14 to the support 48 of the tree stand 40 provides an anchoring point forward of the pillow 10 on the tree stand 40. FIGS. 11-12 show how to adjust the restraining straps 12. The plug end 38 of the side release buckle combination includes a pathway for connecting the end of restraining strap 12 to the plug end 38. The end of the restraining strap 12 is looped through the pathway of the plug end 38. The plug end 38 also acts an adjustment tensioner. By pulling on the end of the restraining strap 12, as shown in FIGS. 11-12, the restraining strap 12 can be shorten to provide the desired tension on the pillow 10 by the restraining strap 12.

Figure 13:
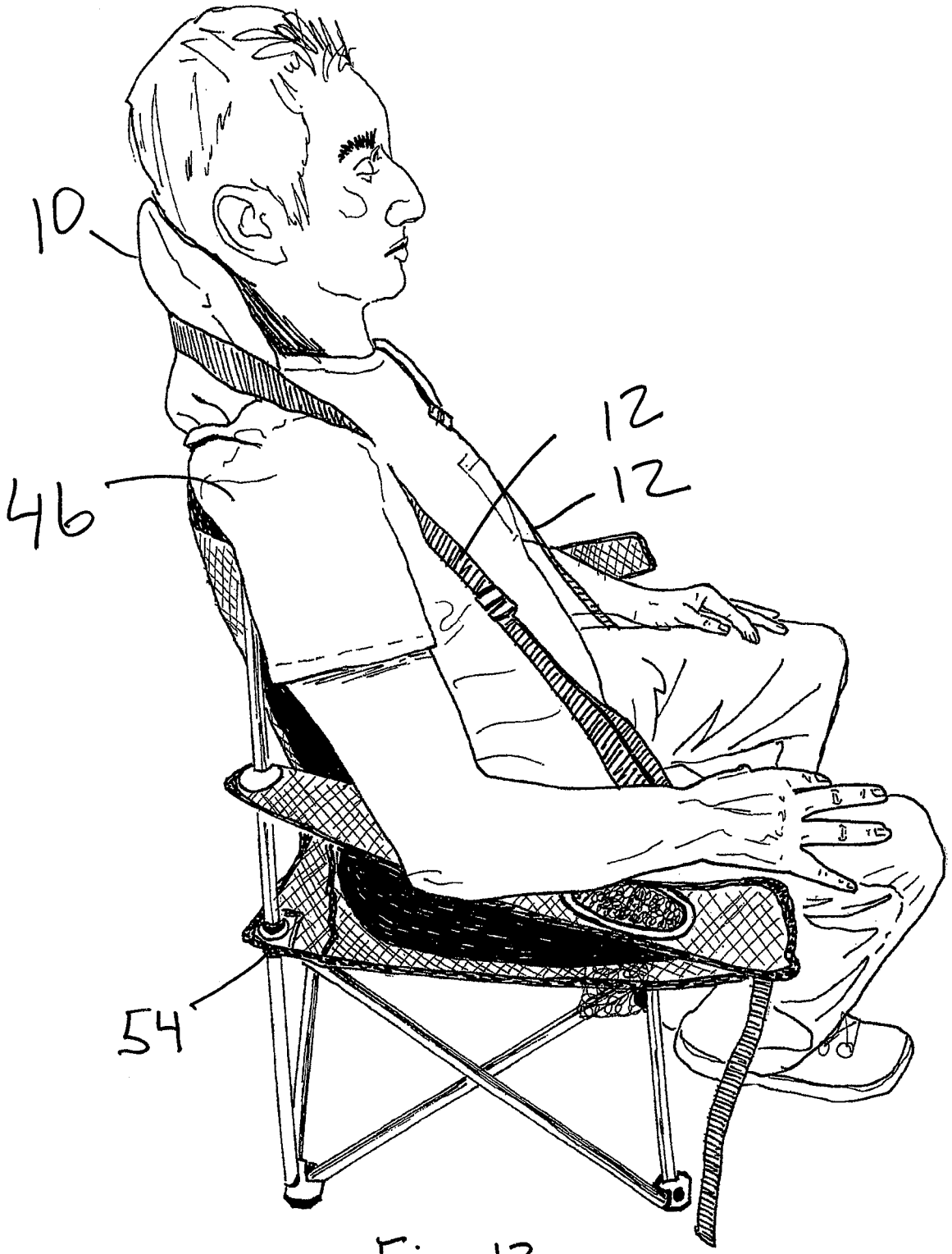
FIG. 13 is a perspective side view of a camp chair and portable headrest according to the present invention.
Figure 14:
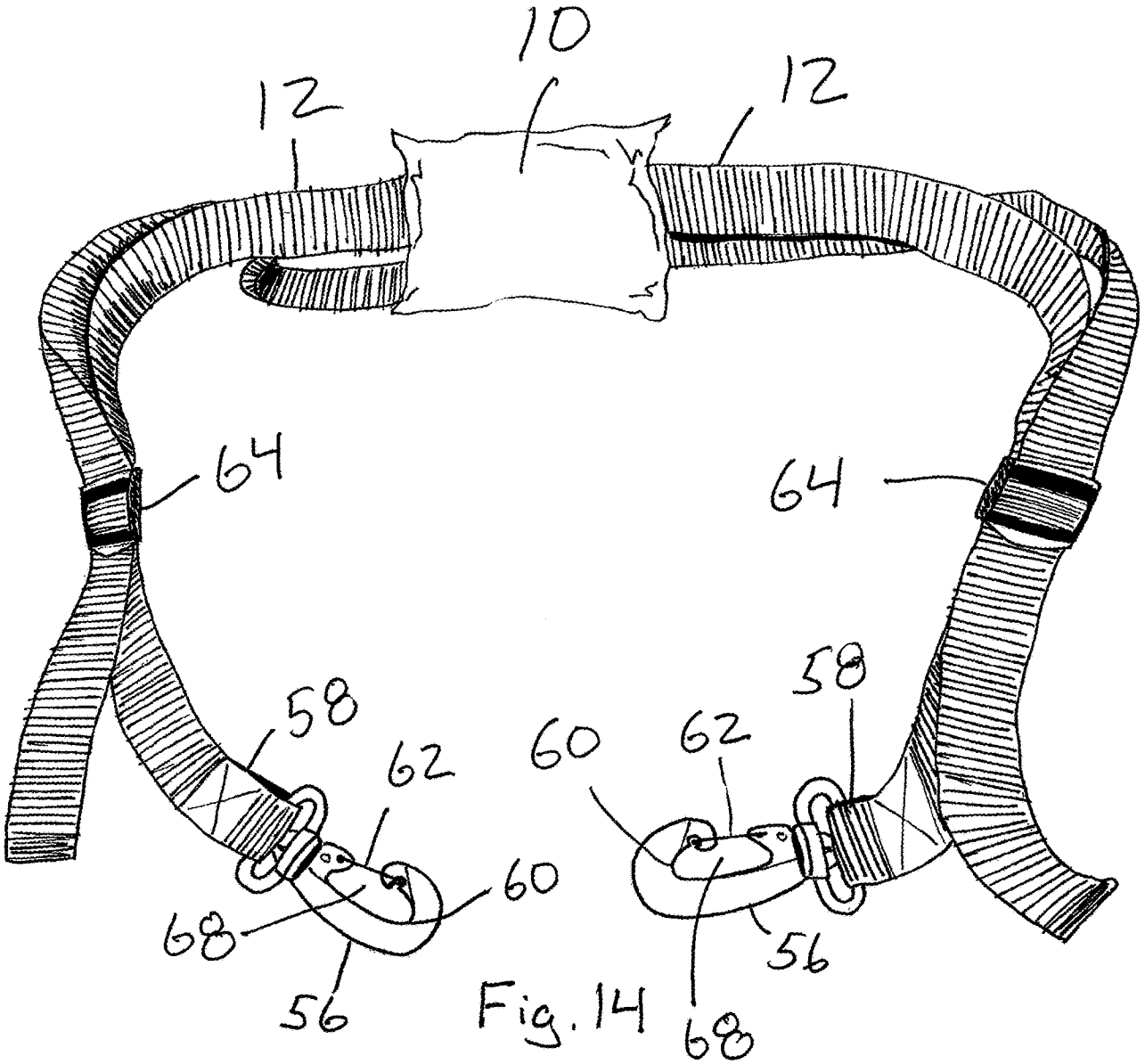
FIG. 14 is a perspective front view of a portable headrest according to the present invention.
Figure 15:
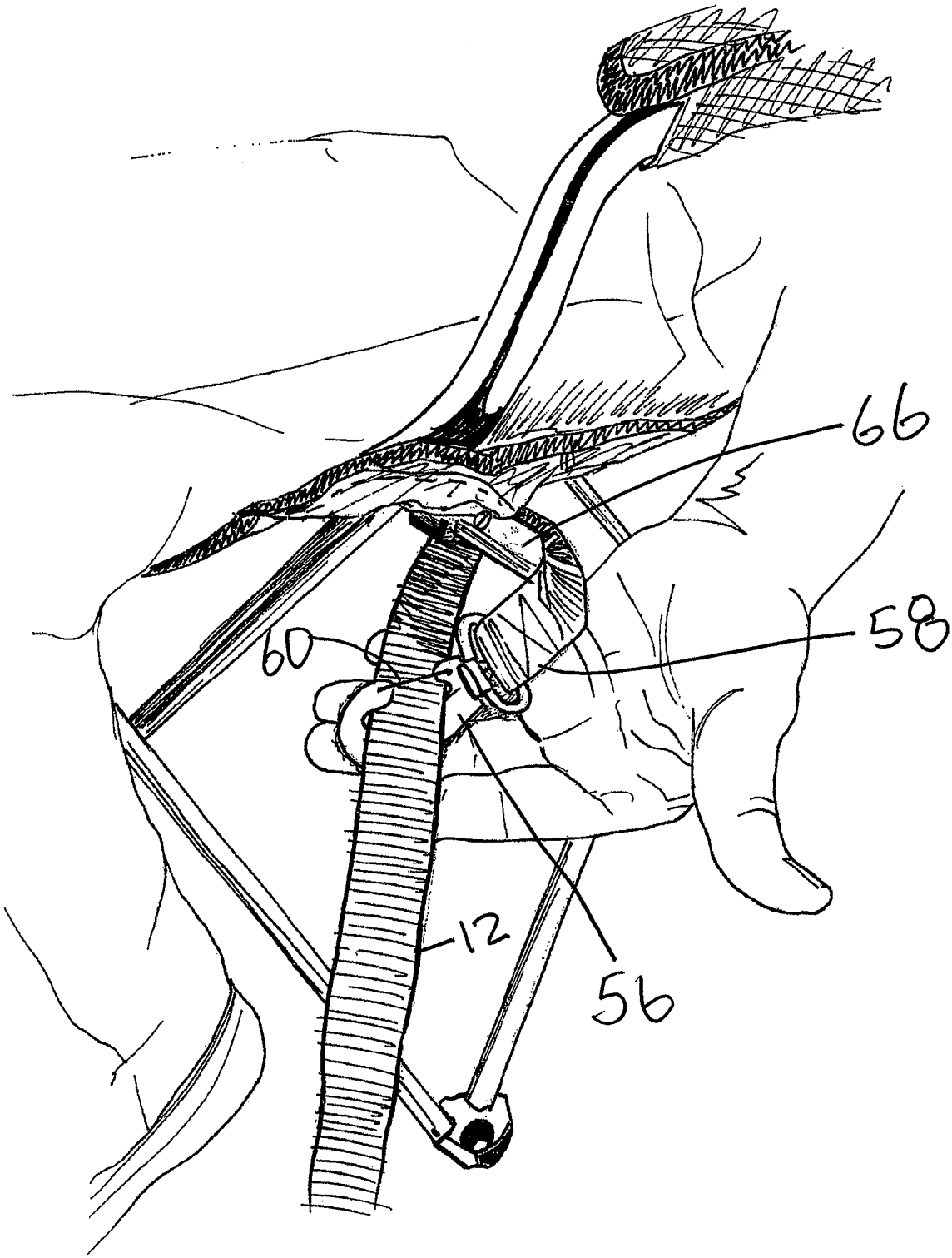
FIG. 15 is a perspective view of an attachment strap according to the present invention.
Figure 16:
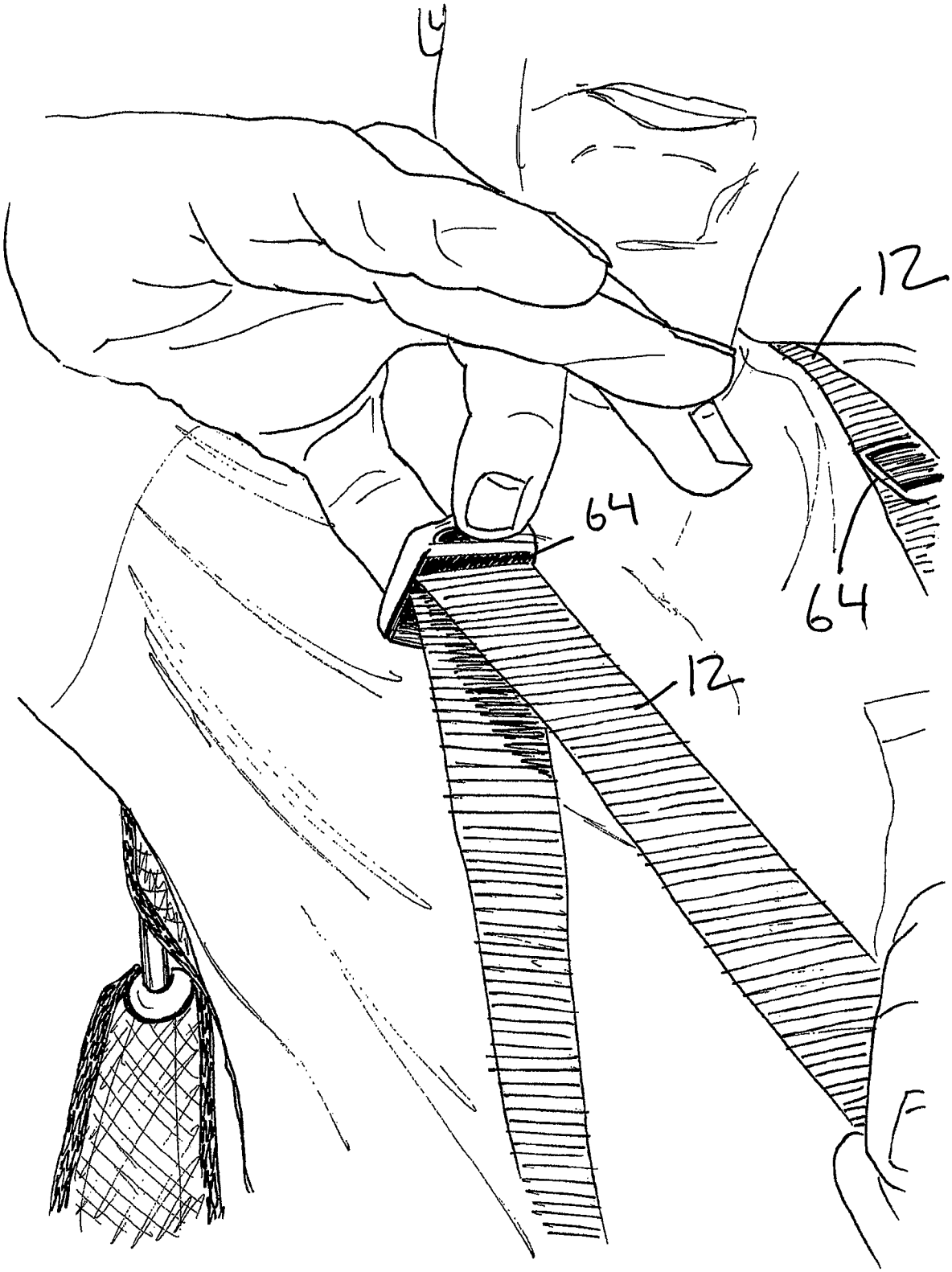
FIG. 16 is a perspective view of adjustment of a restraining strap according to the present invention.
Figure 17:
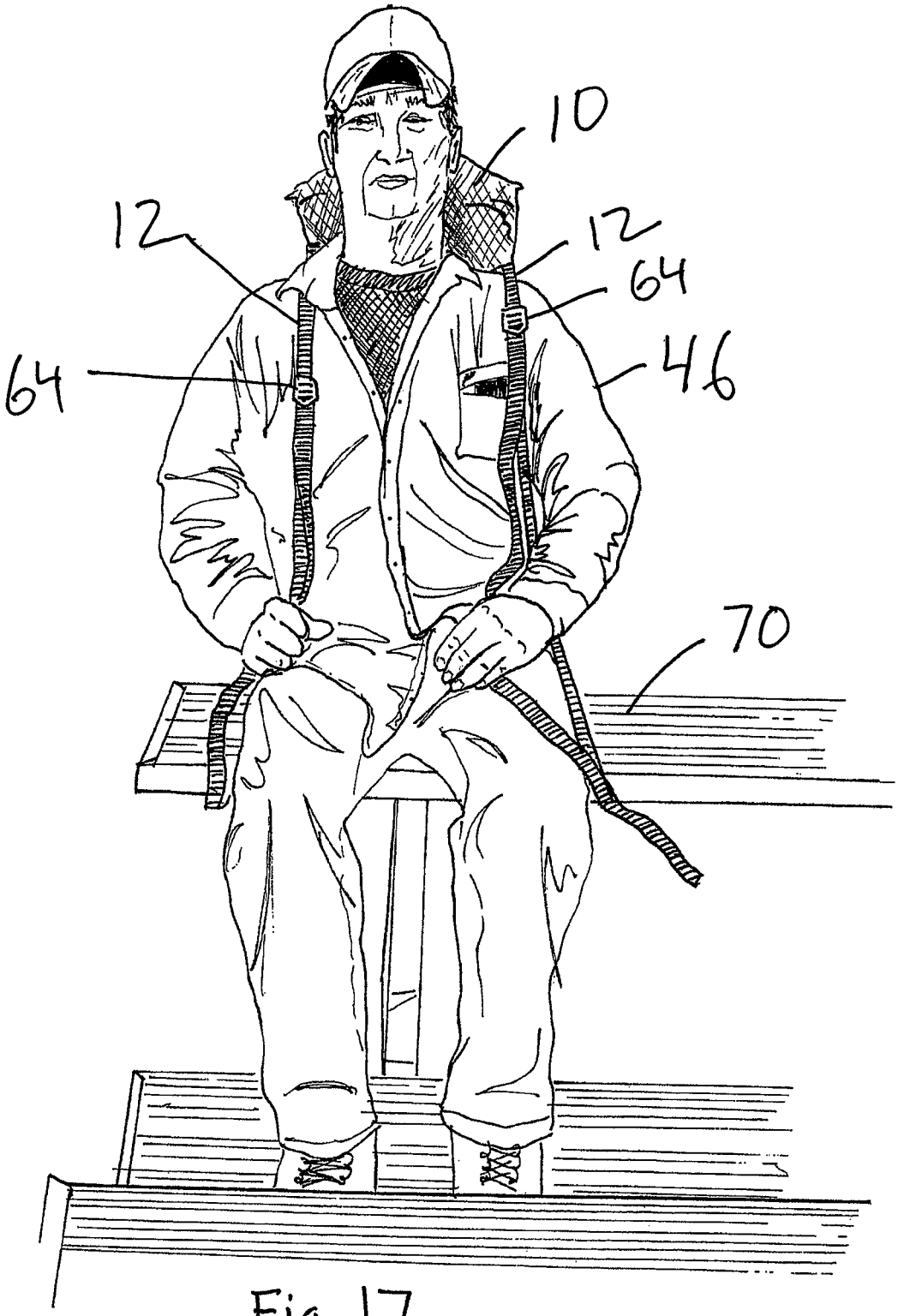
FIG. 17 is a perspective front view of a bleacher and portable headrest according to the present invention.
Figure 18:
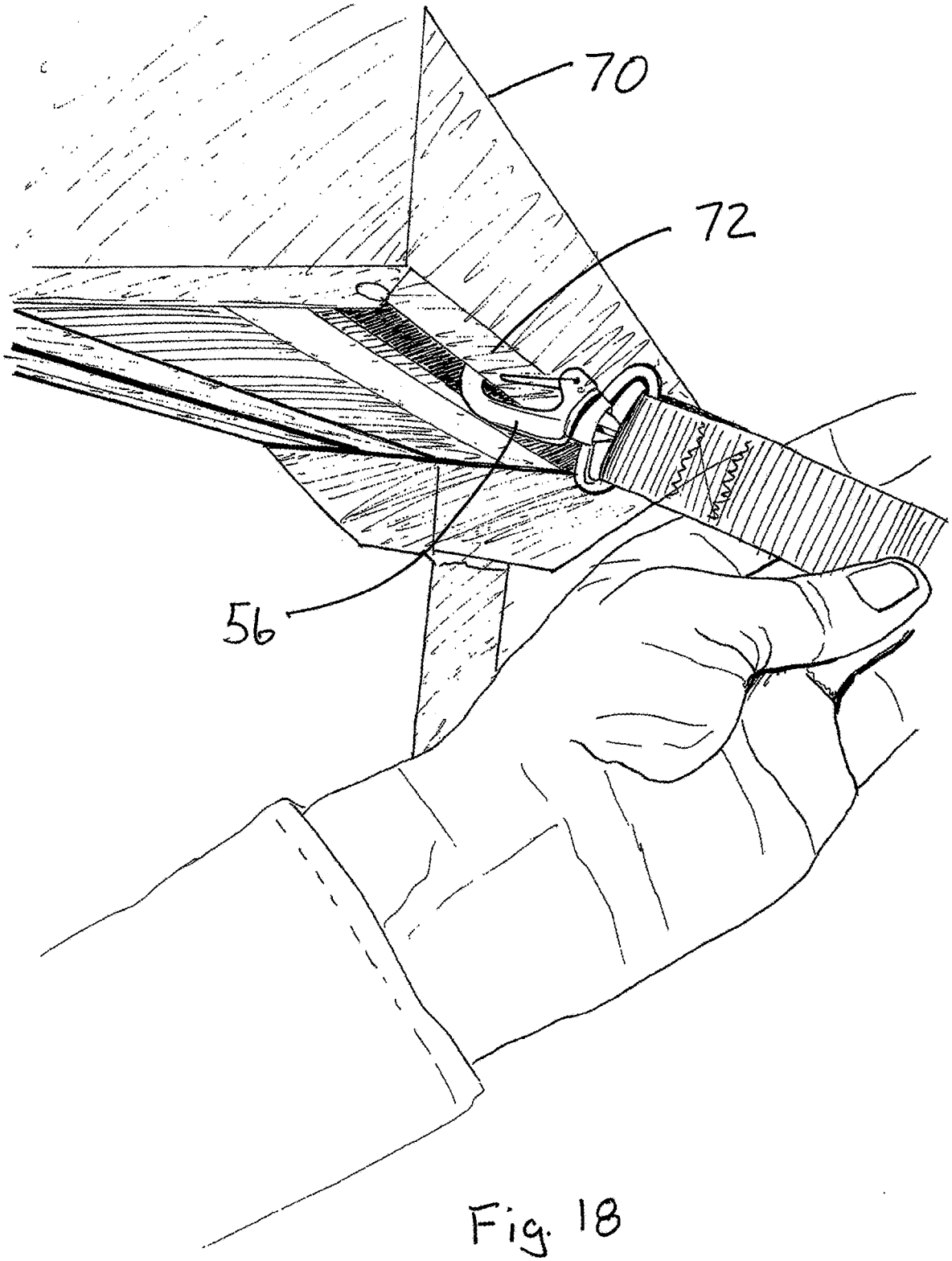
FIG. 18 is a perspective view of an attachment strap according to the present invention.

FIG. 13 shows a second version of the headrest being used by a user 46 on a camping chair 54, even though the first version could also be used on the camping chair 54. FIG. 14 shows the restraining strap 12 with a clip 56 on the ends 58 of the restraining straps 12. The clip 56 is a hook 60 that includes a locking bar 62 to lock the clip 56 on an object. FIG. 14 also shows an adjustment buckle 64 on each restraining strap 12 that acts as the adjustment tensioner. FIG. 15 shows one of the restraining straps 12 wrapped around a support 66 of the camping chair 54. FIG. 15 also shows the opening 68 of the clip 56 attached to the restraining strap 12 with an engaged locking bar 62 to secure the restraining strap 12 about the support 66 of the camping chair 54. With the restraining strap 12 secured to the camping chair 54 at a point forward of the pillow 10, the user can pull on the adjustment buckle 64 to shorten the restraining straps 12 and increase the tension on the restraining straps 12. FIGS. 17-18 show the use of the second version of the headrest by a user 46 on a bleacher seat 70 without a back. FIG. 17 shows the neck of the user 46 being restrained by the pillow 10 with tension on the restraining straps 12. FIG. 18 shows the versatility of the clip 56 of the second version of the headrest. FIG. 18 shows the clip 56 being clipped to an edge 72 of the bottom of the bleacher seat 70. The pillow could also be used to support the back of a user as described above for the different embodiments.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A portable headrest to be used by a user with different seating accommodations that include supports forward of the user, comprising:

a pillow adapted for a user to rest against, said pillow has front surface for resting of the user, a rear surface opposite said front surface, wherein said front and rear include a top edge, bottom edge and two sides opposite each other between said top edge and said bottom edge;

two restraining straps, said restraining straps having a pillow end and an attachment end, said pillow end of said restraining strap attached to said pillow, wherein one of said two restraining straps is attached to one of said two sides at the pillow end of said restraining strap and said other of said two restraining straps is attached to said other of said two sides at the pillow end of said restraining strap so that each of said restraining straps can reach out to the supports while keeping spacing between said restraining strap such that said spacing is adapted for a body of a user to fit between said restraining straps; and a connection device attached to each of said attachment ends of said restraining straps, said connection device is a looped end with a buckle end attached to said attachment ends using a detachable buckle to detach said connection device from said restraining straps so that said looped end can be looped around one of the supports forward of where the user is seated so that said buckle end is threaded through said looped end to encircle the support and tightened around the support for connection of said restraining straps to the support before said buckle end is connected to said restraining straps to provide tension between said pillow and the supports, while keeping spacing between said restraining straps such that said spacing is adapted for a body of a user to fit between said restraining straps.

2. The headrest of claim 1, wherein said restraining strap includes an adjustment tensioner to tighten or release tension on said restraining strap when connected to the support.

3. The headrest of claim 1, wherein said adjustment tensioner is a buckle.

4. A portable headrest to be used by a user with different seating accommodations that include supports forward of the user, comprising:

a pillow adapted for a user to rest against, said pillow has front surface for resting of the user, a rear surface opposite said front surface, said front surface and said rear surface include a top edge, bottom edge and two sides opposite each other between said top edge and said bottom edge;

two restraining straps, said restraining straps having a pillow end and an attachment end, said pillow end of said restraining strap attached to said pillow, wherein one of said two restraining straps is attached to one of said two sides at the pillow end of said restraining strap and said other of said two restraining straps is attached to said other of said two sides at the pillow end of said restraining strap so that each of said restraining straps can reach out to the supports while keeping spacing between said restraining strap such that said spacing is adapted for a body of a user to fit between said restraining straps; and a connection device attached each of said attachment ends of said restraining straps, said connection device is hook shaped clip having a hook end with an open space within said clip outlined by said hook end attached to each of said attachment ends of said restraining straps, wherein said hook shaped clip is configured to hook about one of the supports using said hook end and said open space forward of where the user is seated so that said clip hooks onto the support and provides tension between said pillow and the supports, while keeping spacing between said restraining straps such that said spacing is adapted for a body of a user to fit between said restraining straps.

5. The headrest of claim 4, wherein said clip includes a locking bar attached within an open hook area to retain said attachment end of said restraining strap to the support.

6. The headrest of claim 4, further including an attachment strap, said attachment strap having a restraining strap end and an attachment end, said restraining strap end of said attachment strap removably connected to said attachment end of said restraining strap.

7. The headrest of claim 6, further including a strap interface device between said restraining strap end of said attachment strap and attachment end of said restraining strap to allow said restraining strap and said attachment strap to be connected and disconnected.

8. The headrest of claim 7, wherein said strap interface device is side release buckle combination with a socket end and a plug end, wherein said socket end is attached to one of said restraining strap and said attachment strap and said buckle end is attached to the other of said restraining strap and said attachment strap.

9. A portable headrest system to be used with external supports of a seating area, comprising:

the external supports of the seating area;

a pillow adapted for a user to rest against, said pillow has two sides opposite each other;

at least two separate restraining straps, said restraining straps having a pillow end and an attachment end, said pillow end of said restraining strap attached to said pillow, wherein one of said two restraining straps is attached to one of said two sides at the pillow end of said restraining strap and said other of said two restraining straps is attached to said other of said two sides at the pillow end of said restraining strap so that each of said restraining straps can reach out and attach to said supports while keeping spacing between said restraining straps such that said spacing is adapted for a body of a user to fit between said restraining straps; and a connection device attached at each of said attachment ends of said restraining straps, said connection device connected to said supports so that each of said restraining straps reach out and attach to said supports while keeping spacing between said restraining straps such that said spacing is adapted for a body of a user to fit between said restraining straps.

* * * * *